US005803423A

United States Patent [19]

Harrell

[11] Patent Number: 5,803,423

[45] Date of Patent: Sep. 8, 1998

[54] DEVICE FOR SPACING FURNITURE FROM A WALL

[76] Inventor: Joann W. Harrell, 6117 Indian Hill Rd., Orlando, Fla. 32808

[21] Appl. No.: 718,064

[22] Filed: Sep. 17, 1996

[51] Int. Cl.[6] ..... A47B 97/00

[52] U.S. Cl. ..... 248/345.1

[58] Field of Search ..... 248/345.1, 188.1, 248/346.11, 615; D8/402, 403

[56] References Cited

U.S. PATENT DOCUMENTS

| | | | |
|---|---|---|---|
| D. 71,893 | 1/1927 | Vivirito . | |
| D. 154,101 | 6/1949 | Cowdroy | D54/2 |
| D. 154,303 | 6/1949 | Pavlinetz | D35/2 |
| D. 221,958 | 9/1971 | Finebaum | D33/1 |
| D. 246,625 | 12/1977 | Becker, III | D6/191 |
| D. 253,506 | 11/1979 | Vigue | D6/191 |
| D. 257,222 | 10/1980 | Woodard | D8/402 |
| D. 257,761 | 1/1981 | Abel | D8/402 |
| D. 260,855 | 9/1981 | Hobson | D6/99 |
| D. 271,070 | 10/1983 | Durkee | D6/191 |
| D. 278,012 | 3/1985 | Doerner | D6/495 |
| D. 287,446 | 12/1986 | Cowle | D6/491 |
| D. 288,290 | 2/1987 | Angle | D8/400 |
| D. 288,291 | 2/1987 | Angle | D8/400 |
| D. 302,939 | 8/1989 | Ruskin | D8/402 |
| D. 318,389 | 7/1991 | Hawkinson | D6/495 |
| D. 330,159 | 10/1992 | Dodds | D8/403 |
| D. 331,696 | 12/1992 | Graham | D8/402 |
| D. 333,424 | 2/1993 | Kramer | D8/402 |
| D. 336,033 | 6/1993 | Welsh | D8/403 |
| D. 336,424 | 6/1993 | Barber | D8/402 |
| D. 356,946 | 4/1995 | Rekuc | D8/403 |
| D. 359,231 | 6/1995 | Irons | D8/402 |
| D. 379,928 | 6/1997 | Bowen et al. | D8/402 |
| 750,936 | 2/1904 | Blodt | 211/27 |
| 2,472,607 | 6/1949 | Mihalyi | 95/57 |
| 3,289,995 | 12/1966 | Taylor | 248/345.1 |
| 4,202,134 | 5/1980 | Morrison | 46/92 |
| 4,582,739 | 4/1986 | Givens | 428/83 |
| 4,998,699 | 3/1991 | Butler | 248/345.1 X |
| 5,249,767 | 10/1993 | Mellen | 248/188.2 |

*Primary Examiner*—Leslie A. Braun
*Assistant Examiner*—Anita M. King

[57] ABSTRACT

The device maintains a particular spacing, chosen from a selection of available spacings, between an item and a wall-like surface. The device comprises a single piece of rigid, preferably clear material having top and bottom surfaces which are parallel to each other and perpendicular to the sides. The perimeter is substantially curvilinear, and asymmetric. There are pairs of parallel sides, each side having an incurvate void of varying depth between disparate arms. Abutment surfaces for spacing exist on the sides. Spacing is defined by the distance between the abutment surface on the incurvate void of one side of a pair of parallel sides and the abutment surfaces on the arms on the opposite side of the same pair of parallel sides. Inverting the sides accesses a new spacing. Functional symbols are affixed to the top surface facilitating easy installation. Used in pairs, this device is effective for separating a furniture item from a wall-like surface. No additional hardware is required.

11 Claims, 2 Drawing Sheets

DEVICE FOR SPACING FURNITURE FROM A WALL

BACKGROUND—FIELD OF THE INVENTION

This invention relates to a device which can be used for separating and spacing a furniture item from walls and more particularly to a clear, one-piece, adjustable device for separating and spacing a furniture item from a wall, wall covering, or window covering without the need of hardware.

BACKGROUND-DESCRIPTION OF THE PRIOR ART

Seating furniture has a tendency to move backward with use. Heavy pieces of furniture are frequently furnished with castors to facilitate movement for cleaning, but this also facilitates movement at unwanted times. As the furniture moves, it rubs walls, wall coverings, or window coverings. This in turn damages both the edge of the furniture and the article it rubs against. Furthermore, such close proximity brings additional insult of greasy stains due to hand, arm, or hair contact against the wall. Because costly damage occurs quickly if not checked, the typical homemaker or service person must continually pull heavy furniture from the wall, thereby risking personal injury.

Devices have been used to address this problem such as rubber coaster styled feet. However, these were designed for a different purpose, floor protection; and they require lifting the heavy furniture off the floor to insert a coaster under each support. Furniture can move out of these, and they can be unsightly in use. The rubber feet of the past would harden with time then crack or slide, and were known to stain some floors. Repetitive lifting of heavy loads is required to insert and remove the foot each time cleaning is necessary.

Another device attaches to the wall, U.S. Pat. No. D 336,424 Barber June 1993. While it is adjustable and does not require lifting the furniture it does not allow for easy repositioning. Repairs to the wall are required when it is moved. Adjustable distance appears to be limited to two positions beyond the basic position. Hardware present on the device can make it more visible in use. Finally, the presence of skirting at the back of furniture, or a low configuration of frame and castor could make use of this device difficult if not impossible.

Yet another device design exists, U.S. Pat. No. D 257,761 Able January 1981. It apparently has equal range of adjustability as the prior cited device but does not require attachment to the wall. Nor does it require lifting of furniture. The thickness involved in it's design as well as the presence of hardware would tend to make it more visible in use, especially with furniture having exposed legs.

Furthermore, neither of the aforementioned devices exhibit a method of determining the actual distances provided by their adjustments. Thus they require the additional step of measuring the devices as they are extended.

OBJECTS AND ADVANTAGES

Accordingly, besides the Objects and Advantages of the device for spacing furniture from a wall described above, several objects and advantages of the present invention are:

(a) to provide a furniture spacing device which does not require the use of any additional hardware;

(b) to provide a furniture spacing device that it is nearly invisible in use on most floor surfaces;

(c) to provide a furniture spacing device with four predetermined adjustments in depth from the wall to the rear of the furniture support;

(d) to provide a furniture spacing device with symbols denoting the distance of spacing being provided;

(e) to provide a furniture spacing device that requires no lifting of furniture for use;

(f) to provide a furniture spacing device which is slim yet effective in preventing backward movement;

(g) to provide a furniture spacing device which is easy to use, durable, and economical to manufacture.

SUMMARY OF THE INVENTION

In accordance with the present invention in the preferred embodiment a device for spacing furniture from a wall comprising a clear, one-pieced, rigid body having on each side an incurvate void, which is inset varying depths, and which is positioned between disparate arms. The resulting asymmetric shape permits a selection of spacing distances which are indicated on the top surface by functional symbols for easy use. Spacing selections are accessed by rotating the device. No fasteners or hardware are required for use. Other options may include, but are not limited to, the number of spacings, and a selection of rigid materials which may be opaque or pigmented.

DESCRIPTION OF THE DRAWINGS

In the drawings, closely related figures have the same number but different alphabetic suffixes.

REFERENCE NUMERALS IN DRAWINGS

8 top surface

10 incurvate void

12 arm-like structure

14 direction and distance symbols

16 side

DESCRIPTION OF THE PREFERRED EMBODIMENT—FIGS. 1 TO 2

Figure 1:
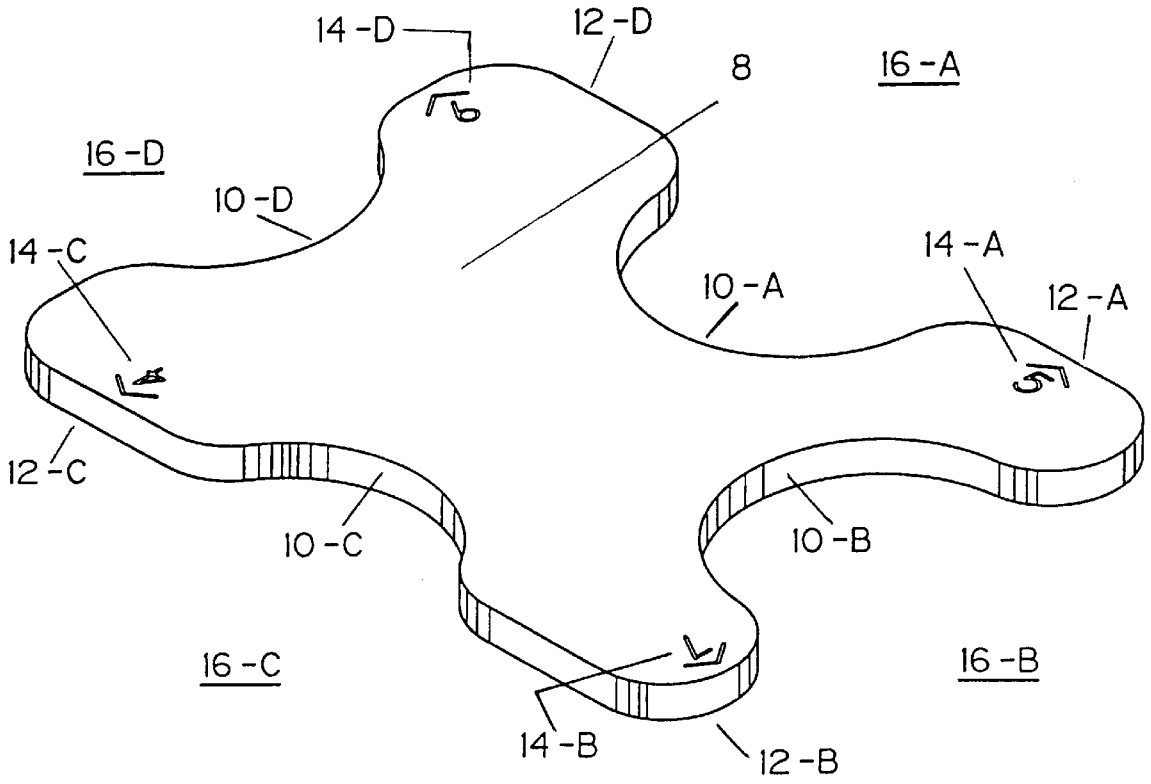
FIG. 1 is a perspective view of the device to separate furniture from a wall embodying the preferred design of the present invention.

Refer now to FIG. 1 which is a perspective view of the present invention in the preferred embodiment. The spacing device of the preferred embodiment is made of rigid, clear plastic such as acrylic; however, other solid materials, coloration and opaqueness remain acceptable options. A thickness of 3/16" provides strength and sufficient height for abutment surfaces on the sides at incurvate voids 10A–10D, and disparate arms 12A–12D; however, this thickness may vary according to the material used. FIG. 1 shows a spacing device which fits a rectangular shape 6" by 8". Incurvate voids 10 are shaped by arcs whose radii are 1½, and angles of 180 degrees. Centers of the radii are located at the midpoint of lines drawn parallel to each side 16A–16D. These parallel lines are inset ½" on side 16-A and side 16-B. Parallel lines are offset ½" on side 16-C, and side 16-D. Variation in the pattern or amount of offset directly effects the spacing distances offered and therefore change overall shape. Resulting disparate arms 12 are shaped by joining the ends of arcs forming incurvate voids 10 to arcs forming outside corners, and short straight line segments. Outside corners of the disparate arms 12 are arcs with ¾" radii and angles of varying degrees. A curvilinear configuration is preferred over angular inside and outside corners to provide added strength, resist chipping, and avoid damage to other surfaces by sharp edges.

Top and bottom surfaces are horizontally flat and parallel relative to each other. Surface finish of the preferred embodiment is smooth and of low reflectivity. The top surface 8 contains a pair of symbols 14A–14D ⅛ from the appropriate edge of each disparate arm 12. Each pair of symbols 14 comprise a directional arrow and a counting numeral whose combined height is ½". The value of the numeral in symbol 14-A is equal to the height of a triangle formed by points located at midpoint of the arc of incurvate void 10-A, and at the abutment surfaces of the two disparate arms 12-B and 12-C lying along side 16-C and opposite void 10-A. Symbols 14 of the preferred embodiment lay recessed from the top surface 8; however, they may be raised from or otherwise incorporated into the top surface 8.

Manufacture of the preferred embodiment is by a molding of resin. However, the spacing device can be made by cutting or stamping the shape from block or sheet stock.

While the general rectangular shape is the preferred embodiment, a polygon having greater even-numbered sides will function in the same manner, allowing additional spacing distances. Conversely, fewer voids can be fashioned, but this reduces the device's flexibility in use. The dimensions of the preferred embodiment may be changed to accommodate a specific environment without altering the usefulness of its form.

Figure 2:
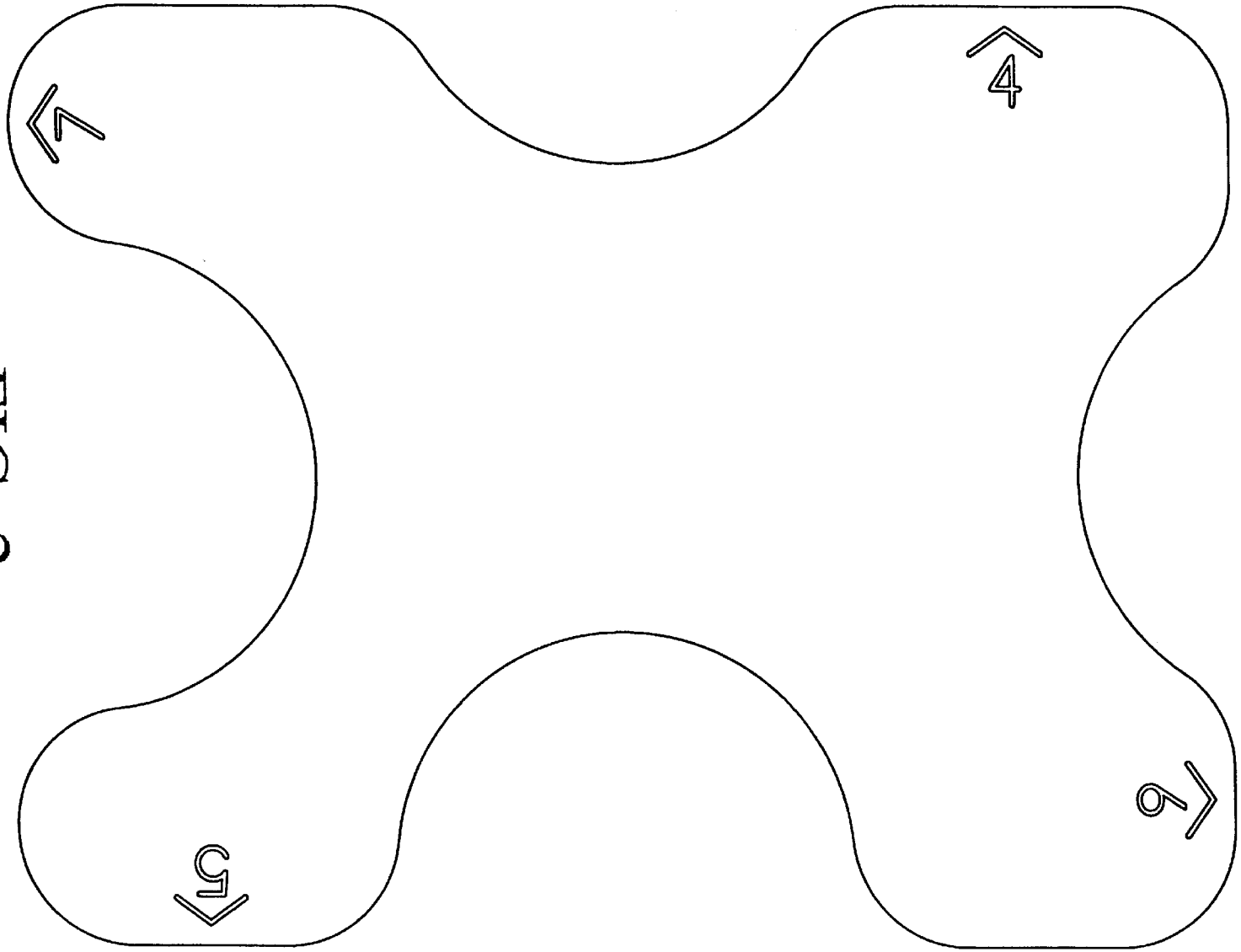
FIG. 2 is a top view of the invention.

Consider FIG. 2, a top view of the preferred embodiment of the present invention. This view shows the actual relationship of incurvate voids 10, arms 12, and symbols 14. There is a direct bearing between the configuration of the invention and it's ability to function as claimed.

OPERATION

The separation device is used in pairs. Each piece is aligned with a rear furniture leg or castor, then placed flat on the floor surface. A separation depth is chosen, then the device is rotated until the appropriate number symbol and it's accompanying direction arrow are pointing toward the wall. As the furniture is moved backward into position, the incurvate void will capture the leg. Properly installed, a leg or castor will abut an incurvate void and the two disparate arms opposite the void will abut the wall. Under normal conditions, if a single furniture item has more that two rear supports, it is only necessary to use the devices at opposite ends of the furniture.

CONCLUSION, RAMIFICATION, AND SCOPE

The device for maintaining a particular spacing, chosen from a number of possible spacings, of the present invention is effective for eliminating the backward movement of an item toward a wall-like surface. Said spacing device comprises a rigid block of pellucid material having a top surface which is horizontally flat and parallel relative to the bottom surface. Sides of said spacing device are perpendicular to top and bottom surfaces and follow the substantially curvilinearly configured perimeter of said surfaces; said perimeter having incurvate voids one per side, located between dissimilar arm-like structures at the corners. Said incurvate void is inset alternating depths from said side, and forms a first abutment surface for said item. Said disparate arms, taken in pairs, form a second abutment surface for said wall-like surface. Said curvilinearly configured perimeter is asymmetric, with said asymmetry being accountable for the multiple possible adjustments in spacing between the rear of said item and said wall-like surface. The desired spacing is accessed by rotation of the device. Appropriate symbols are affixed in the top surface to facilitate use of a desired depth:

Other embodiments may include, but are not limited to, variation in number of available spacings, type of rigid material used, and opaqueness or pigmentation.

I claim:

1. A device for maintaining a particular spacing, selected from a plurality of spacings, between an item and a wall-like surface, comprising:

a substantially flat body having a top surface and a bottom surface and a plurality of pairs of parallel sides;

each of said sides comprising a different sized incurvate void positioned between disparate arms wherein said incurvate voids are inset in an alternating pattern from said pairs of parallel sides by a predetermined amount whereby the shape of the device is asymmetric;

and wherein said incurvate voids form a first abutment surface for said item on a first side of one of said pairs of parallel sides, and said disparate arms form a second abutment surface of said wall-like surface on a second side of said pair of parallel sides, and said first and second sides are invertible whereby the amount of spacing between said item and said wall-like surface may be changed by various positioning of said device.

2. The device of claim 1 further comprising a rigid material.

3. The device of claim 2 wherein the device is a single piece.

4. The device of claim 2 further comprising 2 pairs of parallel sides whereby 4 separate spacings are possible.

5. The device of claim 2 further comprising a clear material whereby the device can be used with low visibility in a great variety of circumstances.

6. The device of claim 2 wherein said incurvate voids are receptive of furniture supporting members.

7. The device of claim 2 further comprising a plurality of functional pairs of numeric and directional symbols located at predetermined positions on said top surface wherein said pairs of symbols number one pair for each available spacing whereby the device can be installed quickly and easily without requiring measuring implements.

8. The device of claim 2 further comprising a substantially curvilinear perimeter whereby the opportunity for damage to said wall or said furniture supporting member by sharp angles is decreased.

9. The device of claim 2 wherein hardware or fasteners are not required for installation or use.

10. The device of claim 2 further comprising "N" pairs of parallel sides where "N" is an integer of at least 2 and no greater than 4 whereby up to 8 separate spacings are possible.

11. The device of claim 2 further comprising an opaque or pigmented material whereby the device will match floor covering.

* * * * *